US007779490B2

(12) United States Patent
Bergkvist

(10) Patent No.: US 7,779,490 B2
(45) Date of Patent: Aug. 24, 2010

(54) BABYSITTER WITH BOTTOM FRAME

(75) Inventor: Håkan Bergkvist, Bromma (SE)

(73) Assignee: BabyBjörn AB, Solna (SE)

( * ) Notice: Subject to any disclaimer, the term of this patent is extended or adjusted under 35 U.S.C. 154(b) by 5 days.

(21) Appl. No.: 12/303,901

(22) PCT Filed: Jul. 6, 2007

(86) PCT No.: PCT/SE2007/000675

§ 371 (c)(1),
(2), (4) Date: Dec. 8, 2008

(87) PCT Pub. No.: WO2008/004958

PCT Pub. Date: Jan. 10, 2008

(65) Prior Publication Data

US 2009/0165209 A1 Jul. 2, 2009

(51) Int. Cl.
*A47D 9/00* (2006.01)

(52) U.S. Cl. ..... 5/101; 5/105; 297/DIG. 11

(58) Field of Classification Search ..... 5/101, 5/102, 105, 106, 655; 297/DIG. 11
See application file for complete search history.

(56) References Cited

U.S. PATENT DOCUMENTS 3,235,306 A * 2/1966 Chernivsky ..... 297/296
4,081,869 A * 4/1978 Ash ..... 5/105
4,188,678 A * 2/1980 Rawolle ..... 5/105
5,203,611 A * 4/1993 Greenwood ..... 297/440.11
5,207,478 A * 5/1993 Freese et al. ..... 297/296
5,509,721 A * 4/1996 Huang ..... 297/452.13
6,594,840 B2 * 7/2003 Tomas et al. ..... 5/655
6,877,802 B2 * 4/2005 Christensen et al. ..... 297/16.1

FOREIGN PATENT DOCUMENTS

GB 2 380 663 A 4/2003

* cited by examiner

*Primary Examiner*—Michael Trettel
(74) *Attorney, Agent, or Firm*—Dickstein Shapiro LLP

(57) ABSTRACT

A bouncing cradle comprises a base frame (10) intended to rest on an underlay, a backrest (20), a pivot mounting (12) arranged for the backrest and carried by the base frame, an arm (22) fixedly connected to the backrest and situated under the backrest as well as at a distance from the pivot mounting, and an adjustment fitting (40) for setting different angles of inclination of the backrest in relation to the base frame, the base frame comprising an essentially plane support yoke (84), the branch ends of which are attached to a support plate (16). The support plate (16) consists of an injection-moulded piece of plastic having integrated tubular sleeves (85) that receive the mutually parallel ends of the yoke branches, and that the sleeves (85) are situated at a distance above the support surface of the support plate (16) facing the underlay.

9 Claims, 5 Drawing Sheets

BABYSITTER WITH BOTTOM FRAME

The invention relates to a bouncing cradle, or bouncy chair, having a base frame, of the kind that is seen in the preamble of the appended independent claim 1.

Thus, the invention relates to a bouncing cradle (children's reclining chair) of the kind that comprises a base frame, which is intended to rest on an underlay such as a floor, a backrest for carrying a child, a pivot mounting arranged for the backrest and carried by the base frame, an arm fixedly connected to the backrest and situated under the backrest as well as at a distance from the pivot mounting, the arm being connected to an adjustment fitting that rests against the base frame at a distance from the pivot mounting, for setting different angles of inclination of the backrest in relation to the base frame. The base frame may, for instance, have a fixed bar for supporting the adjustment fitting, and the adjustment fitting may have two or more recesses with different distances from the connection of the adjustment fitting to the arm, wherein the effective length of the adjustment fitting can be varied by the selection of the recess that is brought into engagement with the bar. By bringing different recesses into engagement with the bar, it is possible to set a number of preselected using positions of the backrest, for instance inclination positions that are suitable for a number of different things to do for the child, such as play, rest, sleep. Furthermore, the adjustment fitting is arranged to allow the backrest to be folded into a position close by the base frame, (transportation of the bouncing cradle).

The base frame should have three support points against the underlay, and further, the base frame should be provided with a pivot mounting for the backrest. In that connection, it is known to form the base frame of a substantially plane yoke, the branch ends of which are attached to a relatively small support plate that carries the pivot mounting of the backrest.

Suitably, the bottom web of the yoke has a considerably greater width than the distance between the branch ends thereof, and the branch ends should furthermore be attached to the support plate above the underlay surface thereof.

The corner areas between the bottom web and branches of the yoke are suitably formed so as to form two spaced-apart support points against the underlay, the support plate forming the third support point.

By the fact that the base frame has three support points against the underlay, it can lie stably also on an uneven floor.

However, in previously known bouncing cradles, the fastening of the yoke to the support plate is delicate in respect of stability and strength, especially because of the load variations that arise because of the play of the child while the child uses the bouncing cradle. Furthermore, in a previously known bouncing cradle construction, it is relatively difficult to establish a pivot mounting for the backrest durable over time.

An object of the invention is to provide a new design of the support plate and the attachment of the yoke branches to the same, in order to entirely or partly obviate the drawbacks outlined above.

An additional object is to provide a support plate that, in the axial direction of the pivot mounting of the backrest, affords a centring of the pivotally mounted part of the backrest.

An additional object is to provide a support plate that automatically affords a detachable locking of the backrest in a transportation position, i.e., when the backrest is lowered against and close by the base frame.

Additional objects and advantages of the invention are seen in the appended claims and the appended drawing and the description.

The object is entirely or partly attained by the invention.

The invention is defined in the appended independent claim. Embodiments of the invention are defined in the appended dependent claims.

In the following, an embodiment of the invention will be described by way of examples, reference being made to the appended drawing.

FIG. 1 schematically and in perspective shows a bouncing cradle.

(In FIG. 1, the bag is shown not fully pulled on, for reasons of lucidity. On the cloth bag, a pair of cloth trousers is shown, into which the child should be put down).

Figure 1:
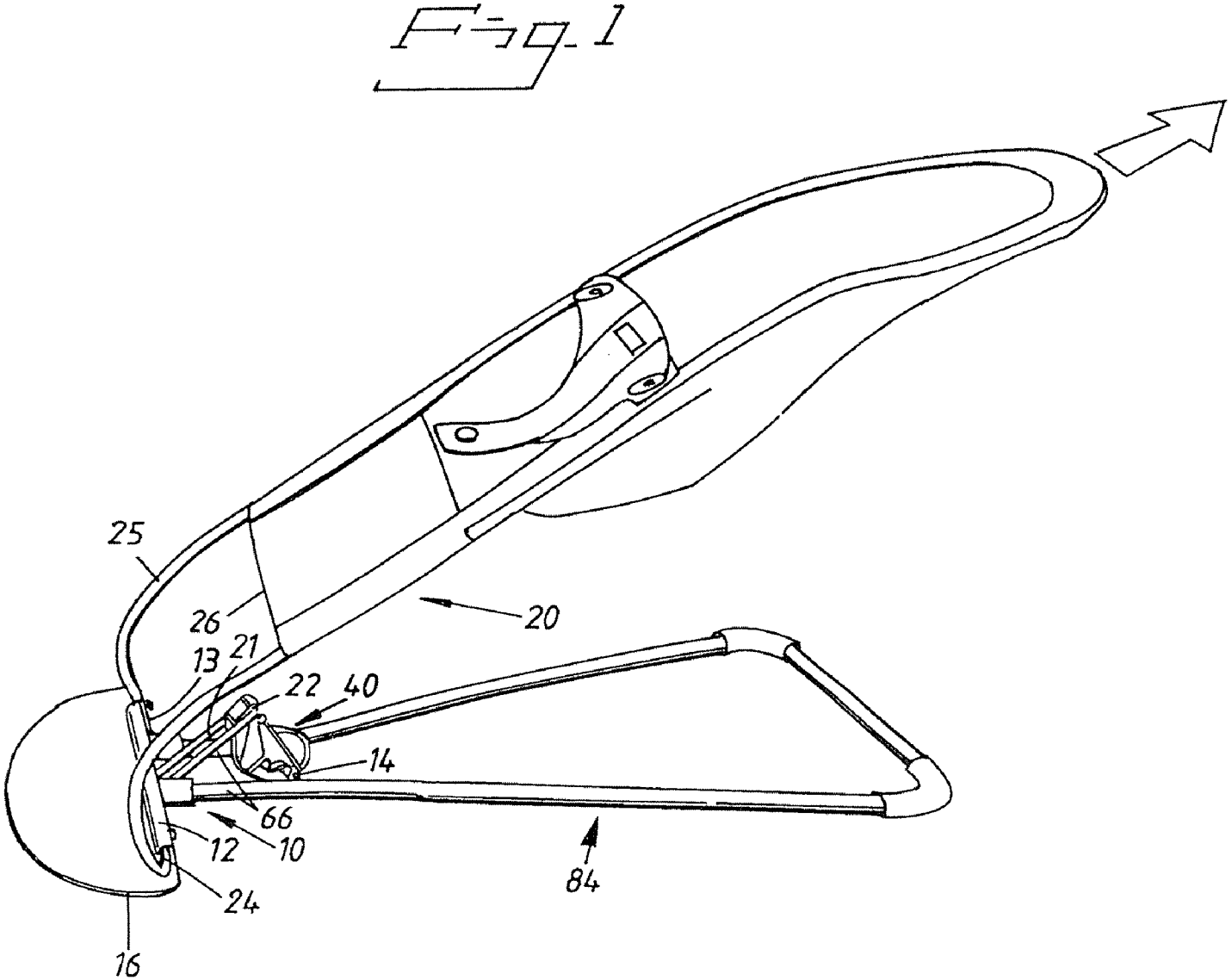
FIG. 1 illustrates a bouncing cradle comprising a backrest 20, which is formed of a generally U-shaped frame part 25 on which a cloth bag is to be pulled on so as to form a reclining support for an infant.

The backrest frame 25 is supplemented by two straight and axially aligned frame pieces 24 and a generally U-shaped yoke integratedly attached between the same.

The frame pieces 24 are received in a pivot mounting 12 along a straight edge 13 of a support plate 16 belonging to a base frame 10, which is intended to stably rest on a horizontal underlay. An essentially flat yoke of a generally triangular nature has the free ends 66 thereof parallel to and attached in the support plate. At a distance from the ends 66, the yoke is widened so as to form two support points, which are laterally spaced-apart in relation to the backrest 20. Said two support points may be established by friction material applied on the underside of the yoke in the corner areas of the yoke between the web and the branches. The support plate 16 may, on the underside along the circumference border thereof, be provided with a strand of friction material, for instance rubber, as anti-skid protection.

It can be seen that a bar 14 extends between the yoke ends 66, the bar 16 being received in the respective hole in the yoke end parts.

An adjustment fitting 40 has a pivot mounting 23 for the web part 22 of the U-shaped part of the backrest frame.

Figure 2:
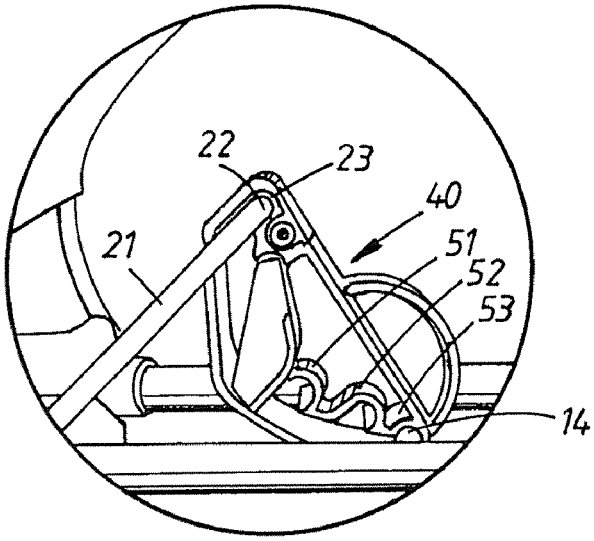
FIG. 2 shows an enlarged depiction of a detail of the bouncing cradle according to FIG. 1, comprising an inclination adjustment fitting.
Figure 6:
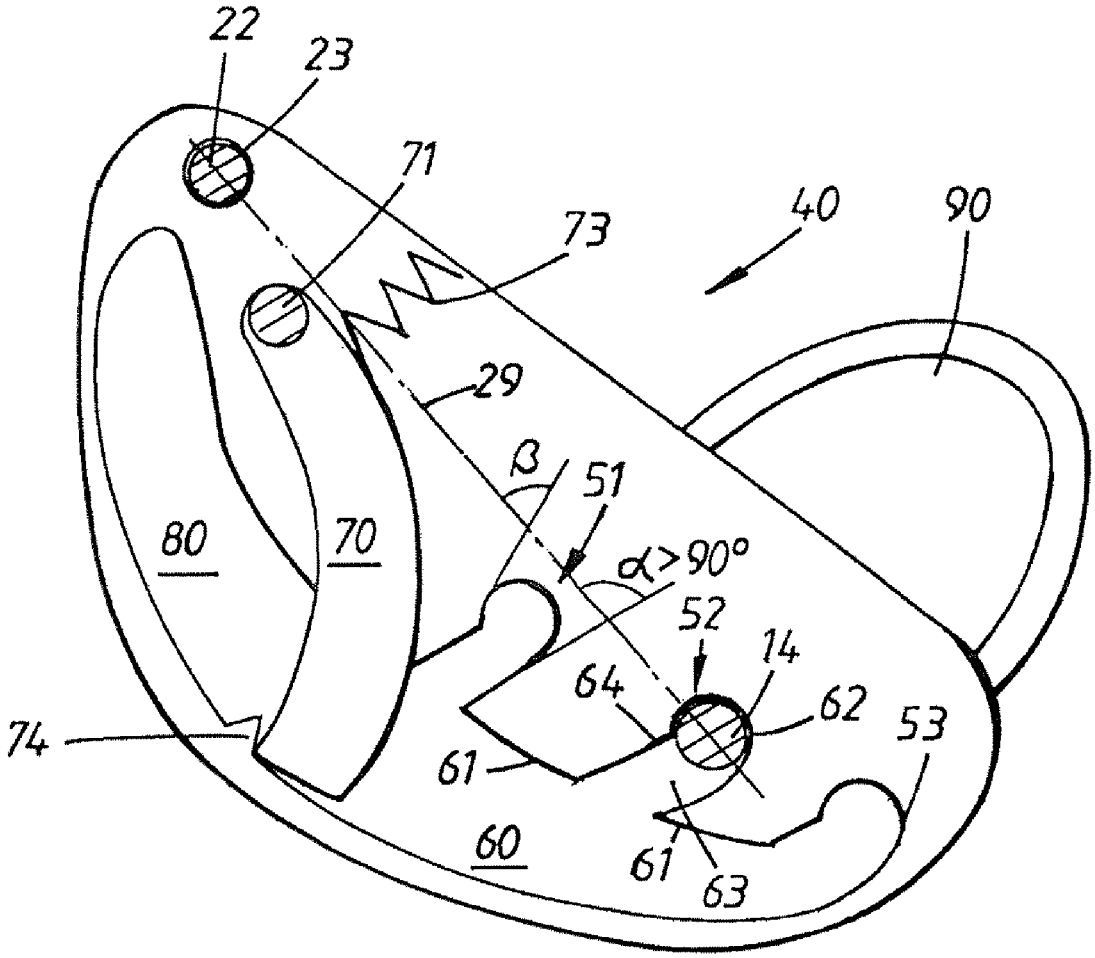
FIG. 6 shows a broken-away side view of the adjustment fitting.

From FIGS. 2 and 6, it can be understood that the bar 14 and the arm 22 are approximately at the same distance from the pivot mounting 12, and that the adjustment fitting 40 has an elongate opening 60 having a side 60, which is turned obliquely downward and facing the first pivot mounting 12 and in which recesses 51, 52, 53 are situated. Each recess has a bottom part 62 that supports the bar 14, and a mouth portion 63 that, obliquely downward and toward the first pivot mounting, mouths in the opening 60. The bar 14, the arm 22 and the pivot mountings 12, 23 are axially parallel.

The elongate opening 60 is delimited toward the upper end thereof by a locking arm 70, which is pivotally mounted around a spindle 71 in the vicinity of the pivot mounting 23, and is biased by a spring 72 toward the end position shown.

By the inclinations accounted for, the bar 14 can always, from the opening 60, slide on surfaces inclined to the vertical into the bottom portion 62 of a recess, when the backrest is loaded vertically. From FIG. 6, it is possible to further see that the mouth portion 63 of the recess has a width that is greater than the diameter of the bar 14, and that the bottom portion 62 of the recess at the upper part thereof is undercut in order to stably receive the bar 14 and prevent the bar 14 from sliding out of the recess, when the backrest is vertically loaded, independently of which recess the bar 14 is received in.

From FIG. 6, it can be seen that the locking arm 70 in the shown end position thereof, by the side thereof facing the opening 60, intersects the upper mouth wall of the recess 51 and forms a guide surface for the introduction of the bar 14 from the opening 60 into the mouth part of the recess 51.

By means of a bias spring 73, the locking arm 70 is biased against a stopper 74. The arm 70 can be turned manually against the action of the spring 73 and, in doing so, brings the opening 60 in communication with an additional elongate opening 80 in the fitting 40, the opening 80 extending up to the area of the pivot mounting 23.

Figure 3:
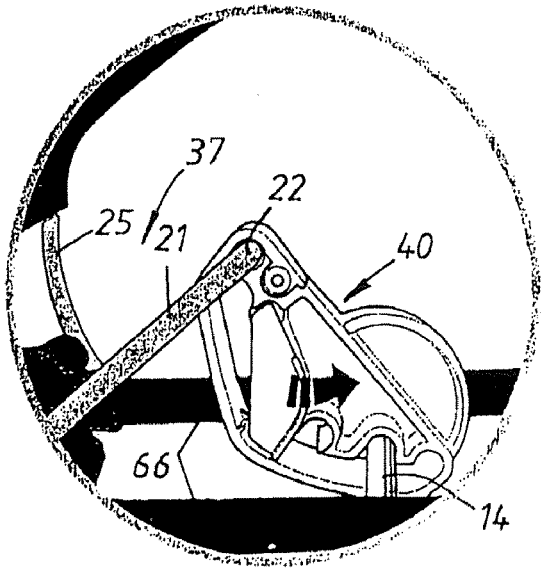
FIGS. 3, 4, 5 show in depictions corresponding to FIG. 2, different rotary positions of the adjustment fitting upon transition from an inclination-determining using position, into a transportation position of the bouncing cradle.
Figure 4:
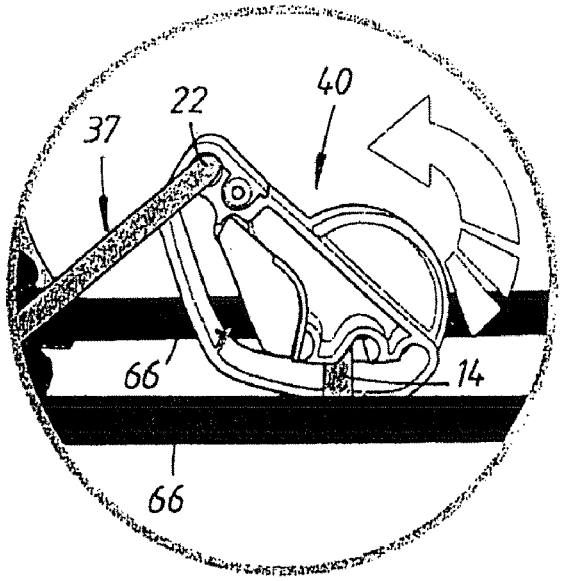
Figure 5:
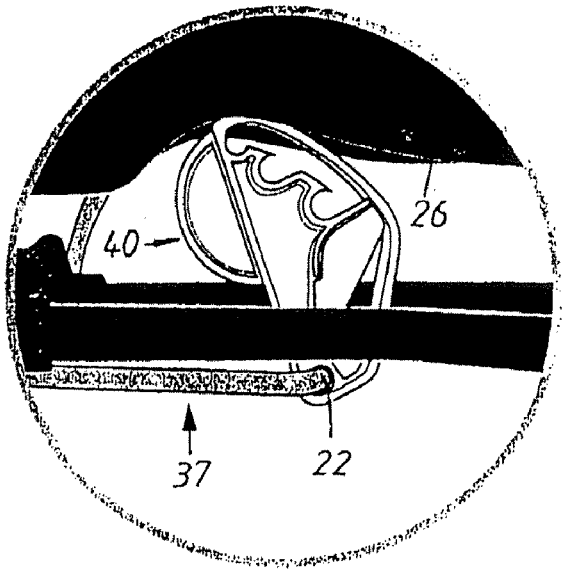

Furthermore, it can be seen that on the outside thereof, the fitting 40 has a gripping ear 90, which facilitates manual turning of the fitting 40 around the mounting 22, 23. FIG. 3 illustrates that the bar 14 is in the recess 52, and that it is desirable to convert the bouncing cradle into a transportation position in which the backrest is generally parallel and next to the base frame 10. In doing so, the locking arm 70 is turned back against the action of the spring 73 in the direction of the arrow indicated in FIG. 3, so that the fitting 40 can be turned in such a manner that the bar 14 leaves the recess 52 and runs along the opening 60 and inward toward the opening 80, such as is indicated by the arrow in FIG. 4. Upon continued turning of the fitting 40 around the mounting 22, 23, the turning motion of the fitting 40 is continued according to FIG. 4 until the fitting 40 assumes the position shown in FIG. 5, in which the pivot mounting 23 is situated in the vicinity of the bar 14 (not shown), the bouncing cradle having assumed the transportation position. In the transportation position, the U-yoke part 37 extends at an angle under the plane of the base frame 10, and the web 22 thereof is situated on a level under the bar 14.

Figure 7:
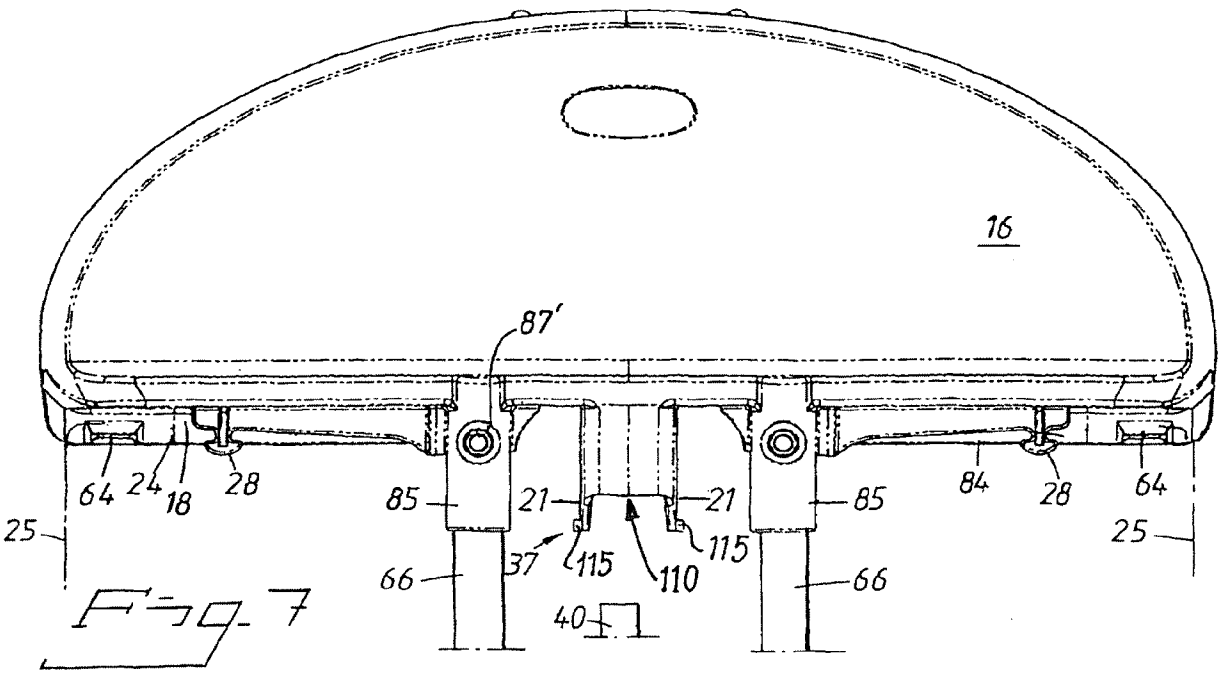
FIG. 7 shows a planar view of a support plate belonging to the base frame.

FIG. 7 illustrates that the support plate 16 has a pair of integrated sleeves 85, which receive the ends 66 of the yoke 84. Furthermore, it is seen that the sleeves 85 as well as the yoke ends 66 have vertically aligned through holes, and that a bolt joint extends therethrough. The bolt joint is shown to have a nut at the top and has a screw head at the bottom. The straight front edge 13 of the support plate has a groove that receives the straight frame pieces 24. The U-yoke part 37, the bottom web of which forms the arm 22, is carried by the frame pieces 24 via the pair of arms 21.

The screw heads 86 of the bolt joints confine the straight frame pieces 24 in the grooves in the support plate 16.

The integrated sleeves 85 afford a stable high-strength connection to the support plate 16, and afford, by means of the bolt joints, a simple connection of the yoke 84 to the support plate 16. From FIG. 7, it is possible to further see that the support plate has integrated buttons 28 that, in addition to confining the frame pieces 24, also afford anchorage of the lower border part of the bag that is threaded onto the frame part 25 for the formation of the backrest 20. In that connection, the front part of the bag has buttonhole openings in alignment with the buttons 28, whereby a stable anchorage of the bag in the stretched state is attained.

Figure 8:
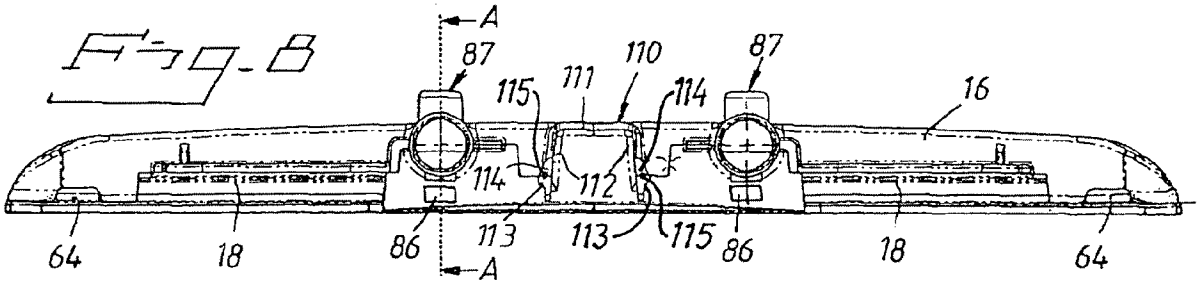
FIG. 8 shows a view taken along the line VIII-VIII in FIG. 7.

From FIGS. 7 and 8, it can be seen that the support plate 16 has a projecting U-girder 110, which is situated between the sleeves 85 and is integrated with the injection-moulded support plate 16. The bottom web 111 of the girder 110 is situated at the topside of the support plate, and the branches 112 thereof extend downward therefrom. The distance between the outsides of the branches is somewhat smaller than the free distance between the branch arms 21 of the U-yoke 37. In this way, the U-yoke 37 is centred and thereby the backrest 20 in relation to the base frame, when the U-yoke is turned down over the U-girder. By the fact that the free branch ends of the girder 110 have generally wedge-shaped protuberances or noses 115 at least at the free end of the girder, an interference between said protuberances 115 and the arms 21 is afforded, and the arms 21 are locked detachably under said protuberances 114 when the arms 21 have passed past them. The branches 112 are elastically resilient and also allow, thanks to a wedge surface 113, a turning back of the U-yoke piece 37 past the arms 21, so that the branches are driven toward each other upon the turning back of the U-yoke 37 away from the transportation position. That is, the branch ends having the wedge surfaces 113, 114 form a detachable catch for the retention of the backrest next to the base frame in the transportation position.

Finally, from FIG. 6, it can be understood that the recesses 51, 52, 53 allow free passage of the bar 14 to and from the bottom portion 62, with the exception of a small dog 64 possibly being arranged at the transition between the mouth portion 63 and bottom part 62 of the recess in the upper wall of the recess. Said dog 64 forms, together with the opposite recess wall, a waist that is somewhat smaller than the diameter of the bar 14. Thanks to an elastic resiliency of the opposite walls of the recess in the vicinity of said dog 64, a snap-locking function is afforded that blocks the bar 14 from unintentionally leaving the bottom part 62 of the recess. The undercut of the upper side wall of the recess in the bottom part serves to guarantee that the bar 14 cannot leave the recess upon loading of the backrest in the direction of the base frame.

The upper side wall of the recess leans at an angle $\beta<90°$ to the line 29 between the centres of the bar 14 and of the arm part 22. The lower side wall of the recess leans, as is seen from FIG. 6, at an angle $\alpha>90°$ to the line 29.

By the fact that the upper wall of the elongate opening 60 has a substantial inclination to the horizontal, independently of the position of the bar 14 along the opening 60, the bar 14 will be able to slide along the upper smooth opening wall, when the backrest is loaded. When the bar 14 then is introduced into a recess 52, 53, the bar will 14 easily slide along the upper smooth mouth wall of the recess, which also has a substantial inclination to the horizontal, and passes into the bottom part 62 of the recess. Hence, the bar 14 automatically makes for one of the recesses 51-53 upon loading of the backrest.

Figure 9:
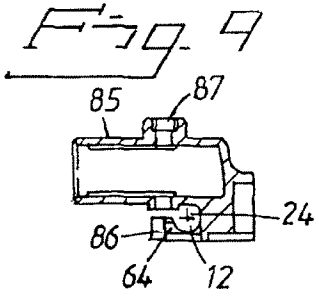
FIG. 9 shows a section taken along the line A-A in FIG. 8.

From FIGS. 7-9, it is possible to further see that each sleeve 85 has a nut socket 87, which rotationally secures a lock nut that receives a through screw, the head of which radially projects from the diametrically opposed side of the sleeve and screens off the groove in order to locally restrain a straight frame piece 24 therein. At the other end of the frame piece, the same is restrained in the groove by a respective dog 64. The screw is suitably of the Allen-type and the nut 87 is suitably a lock nut having friction inserts.

The invention claimed is:

1. A bouncing cradle comprising a base frame (10) intended to rest on an underlay, a backrest (20), a pivot mounting (12) arranged for the backrest and carried by the base frame, an arm (22) fixedly connected to the backrest and situated under the backrest (20) as well as at a distance from the pivot mounting, and an adjustment fitting (40) for setting different angles of inclination of the backrest in relation to the base frame, the base frame comprising an essentially plane support yoke (84) having yoke branches with mutually parallel branch ends attached to a support plate (16), characterized in that the support plate (16) consists of an injection-moulded piece of plastic having integrated tubular sleeves (85) that receive the mutually parallel branch ends of the yoke branches, and that the sleeves (85) are situated at a distance above a support surface of the support plate facing the underlay.

2. Bouncing cradle according to claim 1, characterized in that the support plate (16) has a horizontal groove (18) that receives a straight frame portion (24) of a backrest frame (25) included in the backrest (20), for the formation of the pivot mounting (12), and that the horizontal groove (18) is situated under the sleeves (85) and directed transverse to an axial direction of the sleeves.

3. Bouncing cradle according to claim 2, characterized in that the sleeves (85) and the ends of the yoke branches received therein have vertically aligned diagonally through drillings that receive a fastening joint, the joint having a part (86) projecting from an outer circumference of the sleeve and confining the straight frame portion (24) in the horizontal groove (18) of the support plate.

4. Bouncing cradle according to claim 2, characterized by a dog (64) that is situated at a distance from a fastening joint at respective sides of the support plate, wherein the dog extends from one border part of a groove to a mouth of the horizontal groove (18), in order to contribute to the retention of a longitudinal section of a portion of the backrest frame (25) of the backrest (20) in the horizontal groove.

5. Bouncing cradle according to claim 1, characterized in that the support plate has a girder (110) projecting toward the support yoke and having an elastically resilient portion (112) along the pivot mounting, wherein the elastically resilient portion carries a locking nose (115) that, upon the turning of the arm, interferes with the arm and is locked against raising of the backrest from a transportation position close by the base frame, toward a using position of the backrest.

6. Bouncing cradle according to claim 5, characterized in that the nose (115) has wedge surfaces (113, 114) for the co-operation with the arm toward and away from the transportation position of the bouncing cradle, wherein the wedge surfaces, via co-operation with the arm, produce an elastic deflection of the elastically resilient portion of the girder.

7. Bouncing cradle according to claim 2, characterized in that the backrest frame (25) has two coaxial straight axially spaced-apart frame portions (24), which are received in a respective groove part in the support plate, and that adjacent ends of the frame portions are integratedly connected to a generally U-shaped frame part (37), a branch of which forms the arm connected to the backrest.

8. Bouncing cradle according to claim 1, characterized in that the support plate (16) is provided with fixed buttons (28) that are formed and placed for detachable engagement into respective adjacent keyholes at a mouth border of a textile bag that is threaded over a frame (25) included in the backrest, so as to form a support surface of the backrest.

9. Bouncing cradle according to claim 1, characterized in that the support yoke of the base frame has bottom corners that have friction fittings for the formation of contact surfaces of the support yoke against the underlay, and that the support plate (16), around its circumference thereof, has a rail of friction fittings on its underside thereof.

* * * * *